US005641222A

United States Patent [19]

Minovitch

[11] Patent Number: 5,641,222

[45] Date of Patent: Jun. 24, 1997

[54] LIGHT GUN

[76] Inventor: Michael Andrew Minovitch, 2832 St. George St. #6, Los Angeles, Calif. 90027

[21] Appl. No.: 458,433

[22] Filed: Jun. 2, 1995

[51] Int. Cl.[6] ..... F41G 1/34

[52] U.S. Cl. ..... 362/111; 362/15; 362/234; 362/241; 362/247; 362/255; 431/359

[58] Field of Search ..... 362/111, 13, 14, 362/15, 255, 234, 238, 240, 241, 247, 253; 431/357, 358, 359, 365

[56] References Cited

U.S. PATENT DOCUMENTS

| | | | |
|---|---|---|---|
| 2,393,711 | 1/1946 | Schwarze | 431/358 |
| 2,672,039 | 3/1954 | Schwartz et al. | 431/359 |
| 3,003,053 | 10/1961 | Brooks et al. | 431/359 |
| 3,015,023 | 12/1961 | Dayton et al. | 431/359 |
| 3,094,284 | 6/1963 | Hehl | 431/359 |
| 3,817,683 | 6/1974 | Weber | 431/362 |
| 3,837,786 | 9/1974 | McDonough et al. | 431/359 |
| 3,858,038 | 12/1974 | Buzalski | 362/10 |
| 3,947,221 | 3/1976 | Mauser | 431/359 |
| 4,127,844 | 11/1978 | Purdy | 340/471 |
| 4,278,420 | 7/1981 | Bouchard et al. | 431/359 |
| 4,347,053 | 8/1982 | Fohl et al. | 431/359 |
| 4,424,020 | 1/1984 | Bouchard et al. | 431/359 |
| 5,072,342 | 12/1991 | Minovitch | 362/111 |
| 5,243,894 | 9/1993 | Minovitch | 89/1.11 |

*Primary Examiner*—Alan Cariaso
*Attorney, Agent, or Firm*—Christie, Parker & Hale, LLP

[57] ABSTRACT

A hand-held multiple-shot flash generator is presented for temporarily blinding an assailant at a distance. The light is generated by a plurality of ultra high intensity flash bulbs containing a fast-burning substance such as magnesium sealed in pressurized pure oxygen that is triggered by an electric current. A portion of the glass bulbs is coated with a reflective surface to concentrate and project the light flash in a forward direction. The intensity of the flash striking the eyes is sufficiently strong to cause temporary blindness, thereby rendering the assailant mobile. The flash bulbs are mounted in a cylindrical housing containing a battery and a bulb firing and ejection system designed to give repetitive operation.

18 Claims, 2 Drawing Sheets

LIGHT GUN

BACKGROUND

The amount of violent crime committed in the United States against defenseless victims is very high and increasing at a rapid rate. Consequently, there is a strong demand for effective self defense devices.

Most defaces used for self defense are (1) fire arms (pistols and rifles); (2) electric shock devices (stun guns); (3) chemical sprays (MACE); or (4) sound generators (whistles or horns). Unfortunately, carrying a concealed weapon such as a pistol requires a gun permit which, in many states, is difficult to obtain. Pistols are also lethal weapons that can result in the victim's death if the victim is overpowered by the assailant. The use of a stun gun to disable an assailant by electric shock requires physical contact with the assailant. But this close proximity operation of stun guns makes the victim vulnerable to being overpowered by the assailant. Projecting a chemical spray into the eyes of an assailant is not easy or effective unless the victim is relatively close to the assailant, and hence, vulnerable to being overpowered. Making a noise or sounding an alarm is useless against a determined assailant.

My previous light gun inventions (U.S. Pat. Nos. 5,072,342 issued Dec. 10, 1991 and 5,243,894 issued Sep. 14, 1993 entitled "Light Gun") represented a fundamentally new innovation in the art of self defense devices in that they provided a means for mobilizing an assailant at a safe distance by temporarily blinding the assailant. They were designed to generate a light flash by discharging an energy storage capacitor through an electronic flash robe. However, those devices required high energy storage capacitors which are expensive. The present invention represents an important technical improvement over my previous light guns in that the light flashes are generated by a different process that is utilized to obtain much greater flash intensifies at lower cost. The system is also designed to operate repetitively as a multiple-shot light gun.

BRIEF SUMMARY OF THE INVENTION

Thus, in the practice of this invention, the presently preferred embodiment typically comprises a plurality of hermetically sealed, current activated, flash bulbs made of quarz glass mounted in a column and a battery for triggering the bulbs. The flash bulbs are nearly spherical with an outside diameter of about 1½ inches and contain many filaments of magnesium designed to burn almost instantaneously in a brilliant light flash. The flash intensity of the bulbs is boosted by filling the interior with compressed oxygen gas. The bulbs are fired sequentially by an electric current fed into the bulbs by a standard 9 volt battery. The peak intensity is approximately 20 million ($2\times10^7$) lumens (which is approximately 1,000 times brighter than the sun at noon) and exceeds 10 million ($10^7$) lumens for a period of about 20 milliseconds (20 msec). The time to reach peak intensity is about 30 msec. Thus, it is impossible to avoid receiving a blinding light flash by closing the eyes if the eyes are open when a flash bulb is fired. The total intensity of the light flash projected in front of a bulb is increased by coating the rear hemisphere with a reflective surface and providing an external reflector. The flash bulbs are mounted in a spring-loaded tubular housing and energized sequentially one at a time by the battery. After one bulb is fired, a button is pushed which automatically ejects the spent bulb and the next bulb in the column is advanced to the firing position. By pressurizing the bulbs with pure oxygen gas, they can carry more magnesium filaments to generate a much more intense light flash while having a relatively small size. This is an important design feature of the invention. These super high power flash bulbs can be regarded as "light bullets". Electric current is fed into the bulbs via small electrodes extending on each side. In the preferred embodiment, all of the above mentioned components are mounted inside a cylindrical housing that resembles an ordinary flashlight that can be carded in a man's pocket or in a woman's purse.

DRAWINGS

These and other advantages and features of the invention will be apparent from the disclosure, which includes the specification with the foregoing and ongoing description, the claims, and the accompanying drawings wherein:

DESCRIPTION OF THE PREFERRED EMBODIMENT

As described above, the present invention provides a relatively small, hand-held, battery-operated, chemically powered, multiple-shot light gun for temporarily blinding the eyes of a would-be assailant at a distance with a concentrated flash of light several orders of magnitude brighter than the noon-day sun. In the present invention, this is accomplished by battery activated flash bulbs having a nearly spherical shape containing magnesium filaments hermetically sealed with pure oxygen gas under pressure designed to boost the intensity of the flash. The bulbs are made of quartz glass. The intensity is further boosted by coating the rear of the bulbs with a layer of reflective material so that the light flash is projected in the forward direction. The light intensity is further boosted by an annular reflector mounted around the firing bulb. The system is designed to operate repetitively by mounting a plurality of flash bulbs in a spring-loaded tubular housing that are triggered sequentially, one after another by a battery mounted at the end of the tube. After each bulb is fired, a button is pushed which automatically ejects the spent bulb whereupon the next bulb in the column advances to the firing position. The components are mounted in a cylindrical housing that resembles an ordinary flashlight that can be easily carried. Since the present light gun does not obtain its flash energy from a storage capacitor, it does not require any time for recharging and the amount of flash energy emitted in each flash is many times greater. This results in a vast improvement in the effective blinding capability of the present invention.

Figure 1:
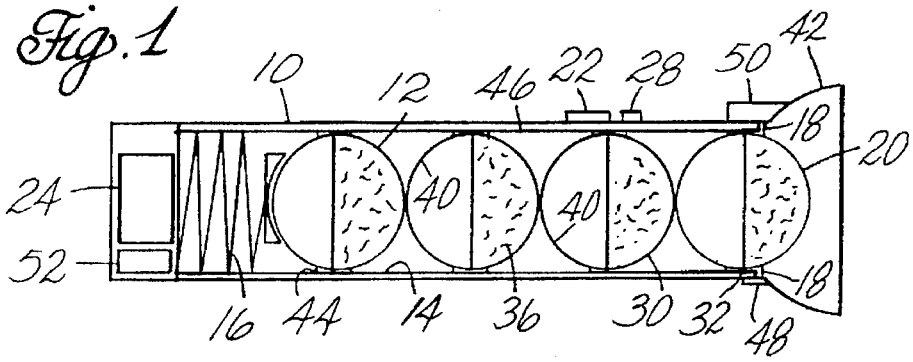
FIG. 1 is a schematic longitudinal cross-section illustrating the design and construction of the preferred embodiment of the invention.
Figure 2:
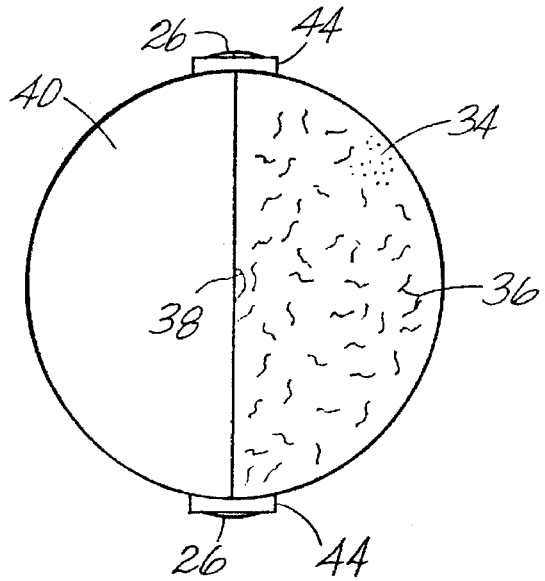
FIG. 2 is a schematic transverse cross-section illustrating the design and construction of the high intensity flash bulbs.

In the preferred embodiment of the invention shown in FIG. 1, the fully loaded light gun 10 holds four flash bulbs (light bullets) 12 in a tube 14. A spring 16 exerts an outward force on the bulbs 12 that tends to push them out of the tube 14. Ejection pins 18, mounted on the front of the tube 14 holds the flash bulbs 12 inside the tube 14. The first bulb 20 is fired by an electric switch 22 which passes an electric current from a battery 24 mounted behind the tube 14 into the bulb 20 via electrodes 26 mounted on each side of the bulbs as shown in FIG. 2. After the bulb 20 is fired, it is ejected from the tube 14 by pressing a button 28 which retracts the holding pins 18. This action ejects the spent bulb 20 and the second bulb 30 is automatically moved into the firing position by the spring 16. When the second bulb 30 moves into the firing position, the electrodes 26 make electrical contact with small plates 32 mounted at the end of the tube. When the firing switch 22 is triggered, current is fed into the plates 32 and hence into the bulb 30.

Figure 3:
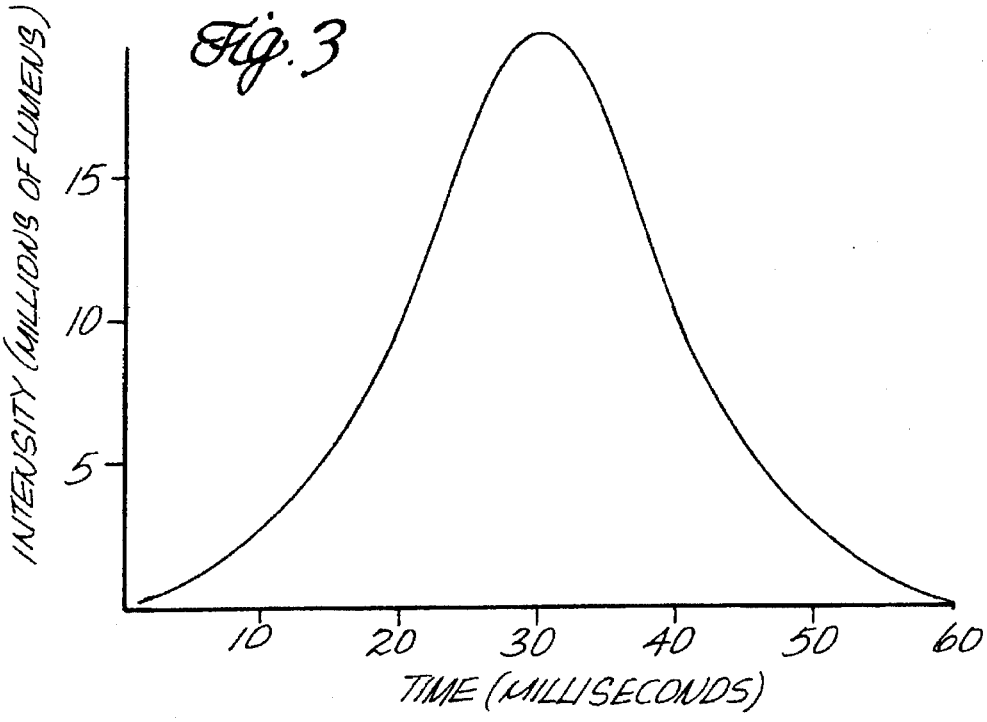
FIG. 3 is a light curve illustrating the intensity of the light flash as a function time.

Referring to FIG. 2, the bulbs 12 have a nearly spherical shape with an outside diameter of 1.5 inches (3.21 cm) and are made with quartz glass. They are hermetically sealed with pure oxygen gas 34 at a pressure above ambient atmospheric pressure and contain many filaments of magnesium 36 designed to burn almost instantaneously in a brilliant flash of light. The magnesium filaments 36 are ignited by bunting a small filament 38 with a current. By sealing the bulbs 12 with pure oxygen gas under pressure it is possible to place a relatively large amount of magnesium filaments into the bulbs 12 to generate a very intense light flash with relatively small bulbs. The resulting light flash will have a peak intensity of about 20 million ($2\times10^7$) lumens which is approximately 1,000 times brighter that the sun at noon on a dear day. The intensity will exceed 10 million ($10^7$) lumens for a period of about 20 milliseconds (20 m sec) which is sufficiently strong to cause temporary blinding for one or two minutes. The time to reach peak intensity is about 30 m sec. Since this time period is shorter than the blink of an eye, it is impossible to avoid receiving a blinding light flash by closing the eyes if the eyes were open when a bulb is fired. FIG. 3 gives the intensity of the light flash as function of time.

One-half of the surface of the bulbs 12 are coated with a highly reflective layer 40 so that all of the light generated by the flash is directed in front of the bulbs thereby increasing the intensity. An annular reflector 42 is mounted around the end of the tube 14 to concentrate the flash and further increase its intensity (see FIG. 1).

Figure 4:
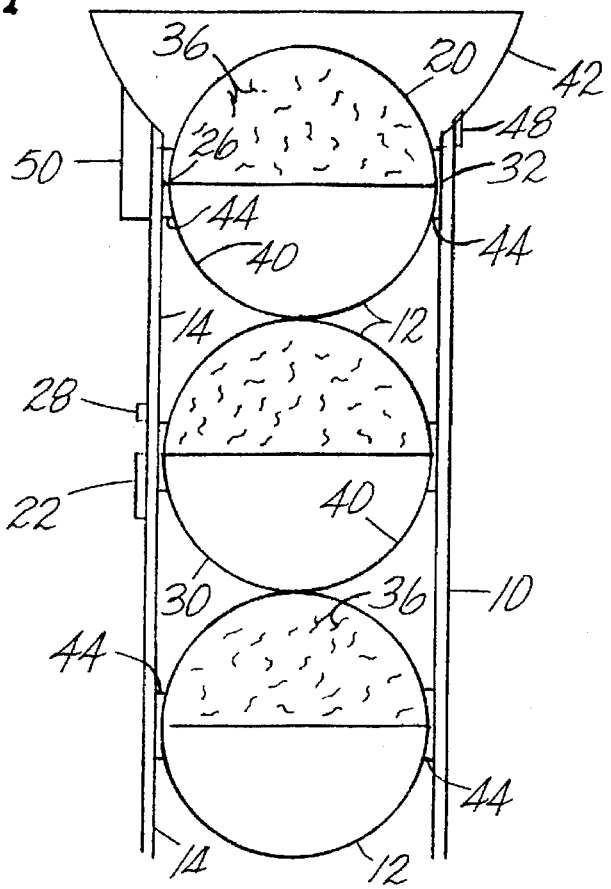
FIG. 4 is an enlarged longitudinal cross-section of the light gun shown in FIG. 1 further illustrating the design and construction of the automatic loading and ejection system for repetitive operation.
Figure 5:
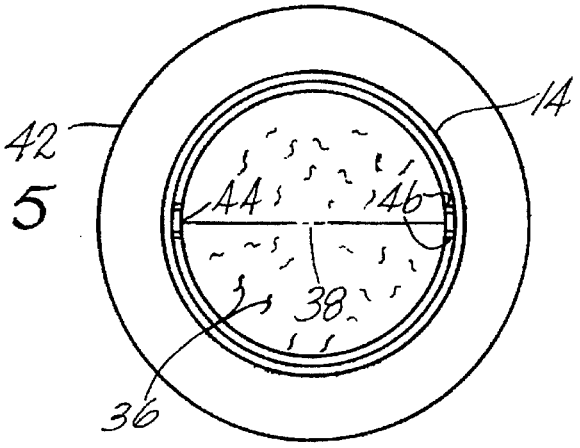
FIG. 5 is a schematic transverse cross-section of the light gun shown in FIG. 4 to further illustrate its design and construction.

Two parallel rectangular guide surfaces 44 are mounted on each side of the bulbs 12 which slide between two pairs of parallel guide tracks 46 extending longitudinally along the inside walls of the tube 14. These surfaces 44 keep the bulbs 12 facing the forward direction while advancing through the tube 14 to the firing position. The electrodes 26 pass through the bulbs and through the guide surfaces 44 and make contact with the rectangular plates 32 mounted between the tracks 46 at the end of the tube 14. FIGS. 4 and 5 are enlarged longitudinal and transverse cross-sections further illustrating the design and construction of the guide surfaces 44 and the guide tracks 46.

An important design feature of this embodiment is the ability to fire all of the light bullets in rapid succession like a machine gun. This is achieved by pushing the firing and ejection buttons simultaneously and keeping them down. This will fire and eject the first bulb 20, and the spring 16 will eject all of the remaining bulbs after it, in quick succession. When they pass over the current plates 32, the bulbs are fired automatically. This will generate a rapid sequence of blinding light flashes ideal for immobilizing a group of assailants.

Although the intensity of the light flashes generated by the light gun is sufficiently strong to temporarily blind an assailant at close range during daylight hours, it is most effective at night. However, in either case, the assailant's eyes must be open when the gun is fired. This can be achieved by deception. The switch 22 is designed to have three positions: off, ready, and fire. When the owner of a light gun believes he or she is going to be attacked, the gun is drawn, and switched to the "ready" position. When the switch 22 is in this position, battery current is fed into a small light 48 mounted near the flash bulb 20 as shown in FIG. 1. It is designed to make the assailant look at the light gun before it is fixed. To increase the assailant's curiosity, battery current is simultaneously fed into an electric sounder 50, also mounted on the front of the light gun 10 to emit a strange noise when the switch 22 is put in the ready position. When the gun is fired, electric current is simultaneously fed into a very loud electric sounder 52 to further disorient, confuse and frighten the assailant while being blinded by the light flash.

Figure 6:
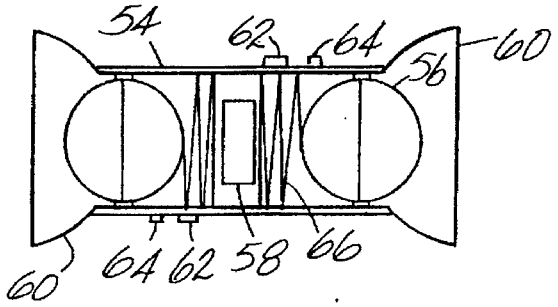
FIG. 6 is a schematic longitudinal cross-section illustrating an alternative embodiment of the invention.

FIG. 6 is a schematic longitudinal cross-section illustrating the design and construction of another embodiment of the invention. In this embodiment the light gun 54 carries two flash bulbs 56 mounted at each end. In this embodiment the gun 54 is shorter, but has a larger diameter for more powerful flash bulbs 56. For example, the bulbs 56 could be designed with an external diameter of 2.5 inches (6.35 cm) and would be about four times as powerful as bulbs having a diameter of 1.5 inches. The battery 58 is mounted between the bulbs 56. Each bulb has its own reflector 60, firing button 62, ejection button 64, and ejection spring 66 which are essentially identical in design and construction to the preferred embodiment described above.

Many modifications and variations of the above embodiments can be devised by one skilled in the art without departing from the scope of the invention. Thus, it is intended that all matter contained into the above description or shown in the accompanying drawings should be interpreted as illustrative and not in a limiting sense.

What is claimed is:

1. A device for immobilizing one or more persons at a distance comprising:

a plurality of flash bulbs containing a sufficient amount of a fast burning substance ignited by an electric current to emit a light flash of at least 10,000,000 lumens;

means for loading said flash bulbs into said device;

battery means for generating said ignition current;

switching means connected to said battery means for triggering said flash bulbs;

ejection means for ejecting spent flash bulbs; and means for mounting said flash bulbs, battery means, switching means, and ejection means in a hand-held housing such that one or more light flashes can be projected into the eyes of said person or persons to temporarily blind said person or persons at a distance for rendering said person or persons immobile.

2. A device as set forth in claim 1 further comprising reflector means mounted on said housing for concentrating said light flashes to increase the intensity.

3. A device as set forth in claim 1 wherein said fast burning subsistence is magnesium sealed in a quartz glass bulb and pressurized with pure oxygen gas to increase the intensity emitted by said flash bulbs.

4. A device as set forth in claim 3 wherein a portion of each of said flash bulbs is coated with a reflective surface to project the light flash in a forward direction to increase the intensity.

5. A device as set forth in claim 1 further comprising means for firing all of said flash bulbs sequentially in rapid succession for generating a series of light flashes.

6. A method for immobilizing one or more persons at a distance comprising the steps of:

loading a plurality of current activated flash bulbs containing a sufficient amount of a fast burning substance to emit a light flash of at least 200,000 lumen-seconds in a housing means; and firing one or more of said flash bulbs by a battery means to create one or more light flashes to temporarily blind said person or persons at a distance rendering said person or persons immobile.

7. A method as set forth in claim 6 further comprising the step of sealing said substance inside said flash bulbs with pressurized oxygen to increase the intensity of said light flashes.

8. A method as set forth in claim 6 further comprising the step of coating a portion of said flash bulbs with a reflective surface to increase the intensity of said light flashes.

9. A device for immobilizing one or more persons at a distance comprising:

a plurality of flash bulbs containing a sufficient amount of a fast burning substance ignited by an electric current to emit a blinding light flash;

means for loading said flash bulbs into said device;

battery means for generating said ignition current;

switching means connected to said battery means for triggering said flash bulbs;

ejection means for ejecting spent flash bulbs;

current generated sounding means connected to said battery means for generating a sound before triggering said flash bulbs; and means for mounting said flash bulbs, battery means, switching means, sounding means, and ejection means in a hand-held housing such that one or more light flashes can be projected into the eyes of said person or persons to temporarily blind said person or persons at a distance for rendering said person or persons immobile.

10. A device as set forth in claim 9 further comprising reflector means mounted on said housing for concentrating said light flashes to increase the intensity.

11. A device as set forth in claim 9 wherein said fast burning substance is magnesium hermetically sealed in said flash bulbs and pressurized with pure oxygen gas.

12. A device as set forth in claim 11 wherein a portion of each of said flash bulbs is coated with a reflective surface to project the light flash in a forward direction to increase the intensity.

13. A method for immobilizing one or more persons at a distance comprising the steps of:

loading a plurality of current activated flash bulbs containing a sufficient amount of a fast burning substance to emit a blinding light flash in a housing;

emitting a sound from said housing to cause said person or said persons to look at said housing; and firing one or more of said flash bulbs after emitting said sound to create one or more light flashes to temporarily blind said person or persons at a distance rendering said person or persons immobile.

14. A device for immobilizing one or more persons at a distance comprising:

a hand-held housing having a substantially cylindrical shape with two ends;

means for mounting a flash bulb containing a fast burning substance ignited by an electric current on each end of said housing, said flash bulbs pointing in different directions external to the housing;

a battery mounted on said housing means; and switching means connected to said battery for triggering said flash bulbs independently of each other for temporarily blinding said person or persons at a distance for rendering said person or persons immobile.

15. A device as set forth in claim 14 further comprising reflector means mounted at each end of said housing means for concentrating the light flashes generated by said flash bulbs to increase the light intensity.

16. A device as set forth in claim 14 wherein said fast burning substance is magnesium hermetically sealed in said bulbs with pressurized oxygen gas.

17. A device as set forth in claim 14 wherein a portion of each of said flash bulbs is coated with a reflective surface to project the light flash in an outward direction to increase the intensity.

18. A method for immobilizing one or more persons at a distance comprising the steps of:

mounting a flash bulb containing a sufficient amount of a fast burning substance to emit a light flash of at least 200,000 lumen-seconds on each end of a hand-held housing; and firing at least one of said flash bulbs to create one or more light flashes to temporarily blind said person or persons at a distance rendering said person or said persons immobile.

* * * * *

UNITED STATES PATENT AND TRADEMARK OFFICE

CERTIFICATE OF CORRECTION

PATENT NO. : 5,641,222
DATED : June 24, 1997
INVENTOR(S) : Michael Andrew Minovitch It is certified that error appears in the above-indentified patent and that said Letters Patent is hereby corrected as shown below:

Abstract, line 10, change "mobile" to -- immobile --.
Column 1, line 8, change "defaces" to -- devices --.
Column 1, line 29, change "mobilizing" to -- immobilizing --.
Column 1, line 32, replace "flash robe" with -- flash tube --.
Column 1, line 37, change "intensifies" to -- intensities --.
Column 2, line 9, change "carded" to -- carried --.
Column 3, line 24, change "bunting" to -- burning --.
Column 3, line 31, change "dear" to -- clear --.
Column 4, line 12, change "fixed" to -- fired --.

Signed and Sealed this

Fifth Day of May, 1998

*Attest:*

BRUCE LEHMAN

*Attesting Officer*

*Commissioner of Patents and Trademarks*